US011468842B2

(12) United States Patent
Heganovic

(10) Patent No.: US 11,468,842 B2
(45) Date of Patent: Oct. 11, 2022

(54) FAST 1H OLED PIXEL CIRCUIT APPLYING DATA TO ANODE

(71) Applicant: Sharp Kabushiki Kaisha, Osaka (JP)

(72) Inventor: Adnan Heganovic, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 17/154,277

(22) Filed: Jan. 21, 2021

(65) Prior Publication Data

US 2022/0230588 A1 Jul. 21, 2022

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01); *G09G 2330/028* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,414,599 | B2 | 8/2008 | Chung et al. | |
| 10,700,146 | B2 | 6/2020 | Chai et al. | |
| 2005/0017934 | A1* | 1/2005 | Chung | G09G 3/3233 345/82 |
| 2015/0070253 | A1* | 3/2015 | Ono | G09G 3/3233 345/76 |
| 2015/0213757 | A1* | 7/2015 | Takahama | G09G 3/3291 345/691 |
| 2016/0141348 | A1* | 5/2016 | Lin | H01L 27/3272 257/40 |
| 2016/0163745 | A1* | 6/2016 | Choi | H01L 27/1225 257/40 |
| 2020/0043411 | A1* | 2/2020 | Tsuge | G09G 3/3266 |

* cited by examiner

*Primary Examiner* — Van N Chow
(74) *Attorney, Agent, or Firm* — Renner, Otto, Boisselle & Sklar, LLP

(57) ABSTRACT

A pixel circuit for a display device minimizes the one horizontal time while maintaining accurate compensation of the threshold voltage of the drive transistor, by extending the compensation phase beyond the data programming phase. The pixel circuit includes a drive transistor configured to control an amount of current to a light-emitting device during an emission phase and a storage capacitor connected between the gate of the drive transistor and the light-emitting device for compensating a threshold voltage of the drive transistor. During a combined data programming and threshold compensation phase, data is programmed and the threshold voltage of the drive transistor is partially compensated, with the data voltage being stored by the internal capacitance of the light-emitting device. The data voltage remains stored during an extended compensation phase in which the drive transistor is further compensated. The pixel circuit includes switch transistors that control the application of supply voltages to the drive transistor, storage capacitor, and light-emitting device during the different phases of operation.

17 Claims, 3 Drawing Sheets

FAST 1H OLED PIXEL CIRCUIT APPLYING DATA TO ANODE

TECHNICAL FIELD

The present application relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

where $V_{DD}$ is a power supply connected to the source of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is decided by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for programming. When the data is programmed during the same operational phase that the drive transistor is compensated, the one horizontal time cannot be reduced further due to compensation accuracy requirements for the drive transistor, as the compensation requirements limit any time reductions for the programming phase.

Another drawback of the U.S. Pat. No. 7,414,599 configuration is that the voltage variation at the VDD driving voltage line, such as the IR drop, will affect the OLED current. At the end of the data programming and compensation phase, the stored voltage across the capacitor is:

$$V_{DD_{PROG}} - (V_{DAT} - |V_{TH}|)$$

where $V_{DD_{PROG}}$ is the VDD voltage during programming and compensation phase, which is applied to a first plate of the storage capacitor, and $V_{DAT} - |V_{TH}|$ is the programmed and compensated voltage at a second plate of the storage capacitor.

The IR drop for each pixel on the same SCAN row will be different depending on the programming data voltage. Similarly, the IR drop for pixels on different rows are different, which means the VDD supply voltage $V_{DD_{PROG}}$ during programming will be different. This difference will cause different OLED currents even with the same data signal and threshold voltage been compensated. The uniformness of the display will therefore be degraded by the IR drop.

Another approach is described in U.S. Ser. No. 10/700,146 (Chai et al., issued Jun. 30, 2020). In this configuration the data voltage is applied to the anode of the light-emitting device. This configuration has very simple control signals and requires only six n-type transistors to operate. However, a significant disadvantage of this configuration is a short circuit current during the initialization phase between the supply voltage ELVDD and a reference voltage VREF, which results in increased power consumption and non-uniformity due to voltage drops. Another drawback of the described configuration of U.S. Ser. No. 10/700,146 is reduced compensation time as the 1H time, when the DATA voltage is available, is shared between the initialization and compensation phases. Therefore, this configuration cannot operate at high refresh rates.

SUMMARY OF INVENTION

There is a need in art, therefore, for an enhanced pixel circuit that provides for adequate and accurate drive transistor compensation while permitting data programming to be performed with minimization of the one horizontal (1H) time. Typically, in circuit configurations in which threshold compensation and data programming are performed within a common operational phase, the threshold compensation accuracy of the drive transistor is limited by the 1H programming time, which is the time the data voltage is available for programming of an individual row, because threshold compensation and data programming are carried out essentially at the same time. Therefore, such circuits cannot operate at very high frequencies and refresh rates. To overcome such deficiencies, embodiments of the present application provide a method to extend the threshold compensation phase past the data programming phase, by storing the data voltage on the anode of the light-emitting device, even when the data voltage input is no longer electrically connected to the pixel circuit. Such operation allows for much shorter 1H times and consequently allows for higher frequencies of operation, while still providing for effective threshold compensation by extending threshold compensation past the data programming phase.

An aspect of the invention, therefore, is a pixel circuit for a display device whereby the one horizontal time is minimized while maintaining accurate compensation of the threshold voltage of the drive transistor, by extending the compensation phase beyond the data programming phase. In exemplary embodiments, the pixel circuit includes a drive transistor configured to control an amount of current to a light-emitting device during an emission phase depending upon a voltage applied to a gate of the drive transistor, the drive transistor having a first terminal and a second terminal and the first terminal of the drive transistor is electrically connected to a first power supply line during the emission phase; a light-emitting device that is electrically connected at a first terminal to the second terminal of the drive transistor during the emission phase and is connected at a second terminal to a second power supply line; and a storage capacitor having a first plate connected to the gate of the drive transistor and a second plate connected to the first terminal of the light-emitting device for compensating a threshold voltage of the drive transistor. During a combined data programming and threshold compensation phase in which data is programmed and the threshold voltage of the drive transistor is partially compensated, the first terminal of the light-emitting device is electrically connected to a data voltage supply line that supplies a data voltage, the light-emitting device having an internal capacitance that stores the data voltage, and the first terminal of the light-emitting device is electrically disconnected from the data voltage supply line during an extended threshold compensation phase during which the threshold voltage of the drive transistor is further compensated. The pixel circuit further may include multiple switch transistors that control the application of supply voltages to the drive transistor, to the storage capacitor, and to the light-emitting device during the different phases of operation.

Another aspect of the invention is a method of operating a pixel circuit to minimize the one horizontal while maintaining accurate compensation of the threshold voltage of the drive transistor by extending the compensation phase beyond the data programming phase. In exemplary embodiments, the method of operating a pixel circuit includes providing a pixel circuit according to any of the embodiments; performing a combined data programming and threshold compensation phase in which data is programmed and the threshold voltage of the drive transistor is partially compensated, the combined data programming and threshold compensation phase comprising electrically connecting the first terminal of the light-emitting device and the second plate of the storage capacitor to a data voltage supply line that supplies a data voltage, the light-emitting device having an internal capacitance that stores the data voltage; performing an extended threshold compensation phase during which the threshold voltage of the drive transistor is further compensated comprising electrically disconnecting the first terminal of the light-emitting device from the data voltage supply line, wherein the data voltage remains stored by the internal capacitance of the light-emitting device during the extended threshold compensation phase; and performing an emission phase during which light is emitted from the light-emitting device comprising applying the first power supply to the first terminal of the drive transistor, electrically connecting the second plate of the storage capacitor to the second terminal of the drive transistor, and electrically connecting the first terminal of the light-emitting device to the second terminal of the drive transistor thereby applying the first power supply to the light-emitting device.

In exemplary embodiments, the method of operating a pixel circuit further may include performing an initialization phase to initialize voltages at the light-emitting device and the drive transistor, the initialization phase comprising: electrically disconnecting the first terminal of the light-emitting device from the second terminal of the drive transistor; electrically connecting the first terminal of the light-emitting device and the second plate of the storage capacitor to the data voltage supply line to apply the data voltage, wherein the data voltage is set such that the light-emitting device does not emit light during the initialization phase; and electrically connecting the gate of the drive transistor and the first plate of the storage capacitor to the first voltage supply line to apply the first voltage supply to the gate of the drive transistor and the first plate of the storage capacitor to reset the gate voltage of the drive transistor To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
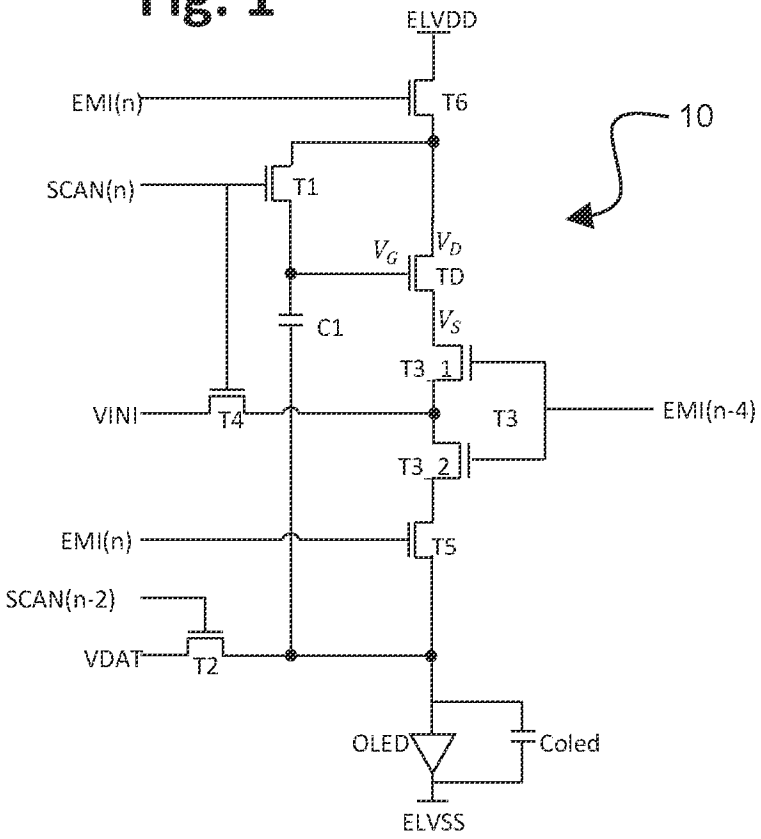
FIG. 1 is a drawing depicting a first circuit configuration in accordance with embodiments of the present application.

Embodiments of the present application will now be described with reference to the drawings, wherein like reference numerals are used to refer to like elements throughout. It will be understood that the figures are not necessarily to scale.

Figure 2:
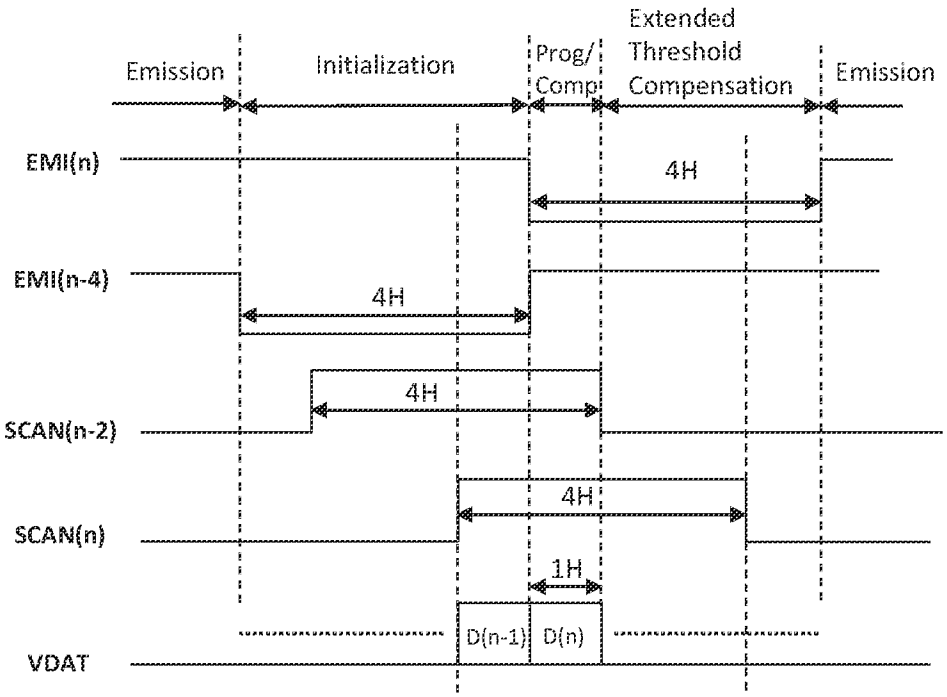
FIG. 2 is a drawing depicting a timing diagram associated with the operation of the circuit of FIG. 1.

FIG. 1 is a drawing depicting a first circuit configuration 10 in accordance with embodiments of the present application, and FIG. 2 is a timing diagram associated with the operation of the circuit configuration 10 of FIG. 1. In this example, the circuit 10 is configured as a thin film transistor (TFT) circuit that includes multiple n-type transistors TD, T1, T2, T3, T4, T5, and T6, and one storage capacitor C1. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple n-MOS or n-type TFTs. TD is a drive transistor that is an analogue TFT, and first through sixth transistors T1-T6 are digital switch TFTs. As indicated in FIG. 1, the drive transistor has a drain, a gate, and a source, with the respective drain, gate, and source being identified in FIG. 1 as $V_D$, $V_G$, and $V_S$. In exemplary embodiments, T3 may be configured as a double gate transistor having a first gate T3_1 and a second gate T3_2 connected in series, which provides a low leakage configuration. As referenced above, C1 is a capacitor and also is referred to as the storage capacitor. $C_{oled}$ is the internal capacitance of the OLED device (i.e., $C_{oled}$ is not a separate component, but is inherent to the OLED). The OLED further is connected to a power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 and other embodiments may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDAT and VINI) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T5 and T2 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to power supply ELVSS in this example. The injection layers, transport layers and emission layer may be organic materials, the first and second electrodes may be metals, and all of these layers may be deposited by a thermal evaporation technique.

Referring to the TFT circuit 10 of FIG. 1 in combination with the timing diagram of FIG. 2, the TFT circuit 10 operates to perform in four phases: an initialization phase, a combined data programming and threshold compensation phase (Prog/Comp.), an extended threshold compensation phase, and an emission phase for light emission. The time period for performing the programming phase is referred to in the art as the "one horizontal time" or "1H" time as illustrated in the timing diagram, with data programming being performed as part of the combined data programming and threshold compensation phase during the 1H time.

For this example and in subsequent embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n and SCAN(n−2) refers to the scan signal at row n−2, and the like. EMI(n) refers to the emission signal at row n and EMI(n−4) refers to the emission signal at row n−4, and the like, and so on for the various control signals. In this manner, for the various embodiments the input signals correspond to the indicated rows. In addition, in exemplary embodiments a pulse width of the various SCAN and EMI control signals is set at four times the one horizontal time, indicated as "4H" in the timing diagram. Such a pulse width for the control signals provides for easy implementation of the pixel circuit control.

As seen in the circuit configuration of FIG. 1, the drive transistor TD has a first terminal (e.g., drain) and a second terminal (e.g., source) opposite from the first terminal, with the first and second terminals being respectively denoted as $V_D$ and $V_S$. As illustrated in the timing diagram of FIG. 2, during a previous emission phase, the EMI(n) and EMI(n−4) signal levels have a high voltage value such that transistors T6, T3 and T5 are in an on state, and light emission is being driven by the input driving voltage ELVDD being electrically connected to the drive transistor TD, whereby the actual current applied to the OLED is determined by the voltage between the gate and the source of the drive transistor. The SCAN signal levels for the applicable row initially has a low voltage value such that transistors T1, T2, and T4 are all in an off state.

The initialization phase is performed to initialize the various circuit voltages, such as voltages at the OLED and the drive transistor. At the beginning of the initialization phase, the EMI(n−4) signal level is changed from a high voltage value to a low voltage value, causing transistor T3 to be placed in an off state. Switch transistor T3 has a first terminal connected to the second terminal (source) of the drive transistor and a second terminal connected to a first terminal of the fifth switch transistor T5. As transistor T3 is turned off, the drive transistor is electrically disconnected from the light-emitting device OLED.

Also during the initialization phase, the SCAN(n−2) signal level is changed from a low voltage value to a high voltage value, causing transistor T2 to be placed in the on state. Switch transistor T2 has a first terminal connected to a first terminal (anode) of the light-emitting device (OLED) and a second terminal connected to a data voltage supply line that supplies a data voltage VDAT. In addition, the storage capacitor C1 has a first plate connected to the gate of the drive transistor and a second plate connected to the first terminal (anode) of the light-emitting device (which also is connected to the second terminal of T2). As transistor T2 is turned on, the anode of the OLED device is set to the data voltage VDAT by applying VDAT to the anode of the OLED through T2. VDAT is set as a negative voltage, which is low enough not to turn on the OLED, and therefore the OLED does not emit light during the initialization phase. In this manner, the anode voltage of the OLED from the previous frame is reset. VDAT also is therefore applied to the second plate of the storage capacitor C1.

Also during the initialization phase, the SCAN(n) signal level is changed from a low voltage value to a high voltage value, causing transistors T1 and T4 to be placed in the on state. Switch transistor T1 has a first terminal connected to the first terminal (drain) of the drive transistor and a second terminal connected to the gate of the drive transistor. As transistor T1 is turned on, the gate and first terminal (drain) of the drive transistor TD are electrically connected to each other through switch transistor T1, and the drive transistor TD becomes diode-connected. Diode-connected refers to the drive transistor TD being operated with its gate and another terminal (e.g., source or drain) being electrically connected to each other, such that current flows in one direction. In addition, switch transistor T6 has a first terminal connected to the driving voltage supply line ELVDD and a second terminal connected to first terminal (drain) of the drive transistor (and to the first terminal of T1). With T6 being in the on state from the previous emission phase and T1 being turned on to diode-connect the drive transistor, the driving voltage ELVDD is applied to the gate of the drive transistor through transistors T6 and T1. In this manner, the previous gate voltage of the drive transistor is reset, and the drive transistor is initialized to a high gate-source voltage in preparation for the subsequent combined data programming and threshold compensation phase.

In addition, switch transistor T4 has a first terminal connected to a reference voltage supply line that supplies a reference voltage *VINI*, and a second terminal connected to the third switch transistor T3. In exemplary embodiments, the second terminal of T4 is connected to a mid-node connection of the first gate T3_1 and the second gate T3_2 of the dual-gate transistor configuration T3. With T4 turning on, the reference voltage VINI is applied to T3 (and to the mid-node of T3 in particular) through transistor T4.

Next, at the beginning of the combined data programming and threshold compensation phase, the signal EMI(n−4) is changed from a low voltage value to a high voltage value, causing switch transistor T3 to be placed in the on state. The signal EMI(n) also is changed from a high voltage value to a low voltage value, causing transistors T6 and T5 to be placed in the off state. Switch transistor T5 has a first terminal connected to the second terminal of the third switch transistor T3 and a second terminal connected to the first terminal (anode) of the light-emitting device. With transistors T6 and T5 turning off, the driving voltage ELVDD and the light-emitting device OLED are electrically disconnected from the other circuit components and thus electrically disconnected from each other.

With switch transistor T3 turning on, the reference voltage supply line that supplies the reference voltage VINI is electrically connected to the second terminal (source) of the drive transistor TD through transistors T4 and T3 via first gate T3_1. As referenced above, the gate voltage of the drive transistor was set to ELVDD during the previous initialization phase. The gate-source voltage $V_{GS}$ of the drive transistor is now:

$$V_{GS}=V_{ELVDD}-V_{VINI}$$

Since the gate node $V_G$ of the drive transistor is floating, the drive transistor TD will inject a current into the source node $V_S$ until the source voltage value of the drive transistor is high enough to turn off the drive transistor to perform the threshold voltage compensation. The voltage on node $V_G$ after such compensation is:

$$V_G=V_{VINI}-V_{TH}$$

where $V_{TH}$ is the threshold voltage of the drive transistor TD.

Preferably, to have effective voltage threshold compensation of the drive transistor TD, the initial voltage difference between the gate and the source of the drive transistor should be:

$$V_{ELVDD}-V_{VINI}>|V_{TH}|,$$

where ΔV is a voltage that is large enough to generate a high initial current to charge the storage capacitor C1 within an allocated threshold compensation time. The value of ΔV will depend on the properties of the transistors. For example, ΔV would be at least three volts for exemplary IGZO (indium gallium zinc oxide) and LTPS (low-temperature polycrystalline silicon) thin film transistor processes. The voltages ELVDD and VINI are set to satisfy this voltage requirement.

As referenced above, during the previous initialization phase switch transistor T2 was placed in the on state, thereby electrically connecting the data voltage supply line to the first terminal (anode) of the light-emitting device (OLED) to apply the data voltage VDAT through transistor T2 to the OLED anode. Therefore, the voltage stored on the storage capacitor C1 is:

$$V_{C1}=V_{VINI}+V_{TH}-V_{DAT}$$

Because of such operation, a shortened 1H time is achieved, and the circuit operation proceeds to the extended threshold compensation phase.

Next, during the extended compensation phase, the signal SCAN(n−2) changes from a high voltage value to a low voltage value, which places switch transistor T2 in the off state. Accordingly, the data voltage supply line VDAT is electrically disconnected from the OLED anode. However, the data voltage VDAT remains stored on the parasitic or internal capacitance $C_{oled}$ of the light-emitting device, and the storage of VDAT on said internal capacitance allows the threshold compensation phase to continue for an extended duration even after the data voltage supply line is electrically disconnected. This improves the accuracy of the compensation scheme and enables the pixel circuit to operate at a high refresh rate as the 1H programming time is considerably reduced.

At the end of the extended threshold compensation phase, the signal SCAN(n) is changed from a high voltage value to a low voltage value, placing switch transistors T1 and T4 in the off state. With transistor T1 turning off, the drive transistor TD is no longer diode connected. With transistor T4 turning off, the reference voltage supply line that supplies the reference voltage VINI also is electrically disconnected from the other circuit components.

The pixel circuit next is operable in an emission phase during which light is emitted by the light-emitting device. During the emission phase, the signal EMI(n) is changed from a low voltage value to a high voltage value, placing transistors T6 and T5 in the on state. The second (bottom) plate of the storage capacitor C1 is now electrically connected to the second terminal (source) of the drive transistor at $V_S$ through transistors T5 and T3. The first (top) plate of the storage capacitor C1 is connected to the gate of the drive transistor at $V_G$. The gate-source voltage of the drive transistor is therefore identical with the voltage stored on the storage capacitor C1 and is:

$$V_{GS}=V_{C1}=V_{VINI}+V_{TH}-V_{DAT}$$

With the voltage supply line ELVDD being electrically connected to the first terminal of the drive transistor TD through T6, the drive transistor now supplies a current to the light-emitting device from the positive to the negative supply rail through transistors T3 and T5. The amount of current supplied by the drive transistor is:

$$I_{OLED} = \frac{\beta}{2}(V_{GS} - V_{TH})^2$$

$$I_{OLED} = \frac{\beta}{2}(V_{VINI} + V_{TH} - V_{DAT} - V_{TH})^2$$

$$I_{OLED} = \frac{\beta}{2}(V_{VINI} - V_{DAT})^2$$

where $$\beta = \mu_n \cdot C_{ox} \cdot \frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor TD, and hence the current to the OLED device $I_{OLED}$ is not affected by threshold voltage variations of the drive transistor. In this manner, any variation in the threshold voltage of the drive transistor has been compensated.

In accordance with the above, the pixel circuit configuration and related operation minimizes the data programming one horizontal (1H) time while achieving adequate and effective threshold compensation time. These advantages are achieved by performing the extended threshold compensation phase after the data voltage supply line is electrically disconnected from the pixel circuit. The extended compensation phase is achieved by storing the data voltage VDAT on the internal capacitance of the light-emitting device. With the shortened 1H time combined with enhanced threshold compensation by the extended threshold compensation phase, the pixel circuit architecture is optimized for high refresh rate applications that otherwise would be unsuitable.

Figure 3:
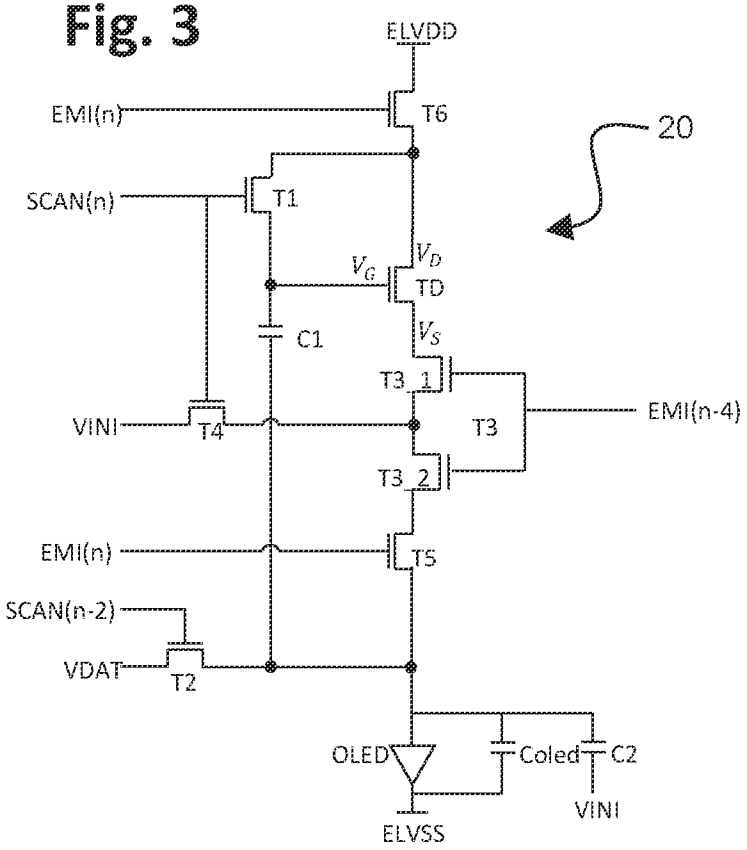
FIG. 3 is a drawing depicting a second circuit configuration that is a variation on the first circuit configuration of FIG. 1, with an additional capacitor connected across the light-emitting device.

FIG. 3 is a drawing depicting a second circuit configuration 20 that is a variation on the first circuit configuration 10 of FIG. 1, with a second storage capacitor C2 connected across the light-emitting device. The second storage capacitor C2 has a first plate connected to the first terminal (anode) of the light-emitting device and a second plate connected to a bias voltage supply input. In exemplary embodiments, the bias voltage supply input may be the reference voltage supply line that supplies the reference voltage VINI, although any suitable voltage supply input may be employed. In the first circuit configuration 10 of FIG. 1, as detailed above the data voltage VDAT is stored by the internal capacitance of the light-emitting device $C_{oled}$ during the extended threshold compensation phase. In the circuit configuration 20 of FIG. 3, the second capacitor C2 increases the total capacitance relative to the anode of the light-emitting device. The presence of the second capacitor C2 enhances the storage of the data voltage VDAT at the light-emitting device during the extended compensation phase so as to maintain the VDAT voltage level at the desired programming voltage value.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present application are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

T1-T6—switch transistors
TD—drive transistor
OLED—organic light emitting diode (or generally light-emitting device)
C1—first storage capacitor
C2—second storage capacitor
$C_{oled}$—internal capacitance of OLED
$V_G$—gate of drive transistor
$V_S$—source of drive transistor
$V_D$—drain of drive transistor
VDAT—data voltage supply line and data voltage
ELVSS—OLED power supply line
ELVDD—driving power supply line
VINI—reference voltage supply line and reference voltage
SCAN/EMI—control signals

What is claimed is:

1. A pixel circuit for a display device comprising:

a drive transistor configured to control an amount of current to a light-emitting device during an emission phase depending upon a voltage applied to a gate of the drive transistor, the drive transistor having a first terminal and a second terminal and the first terminal of the drive transistor is electrically connected to a first power supply line during the emission phase;

a light-emitting device that is electrically connected at a first terminal to the second terminal of the drive transistor during the emission phase and is connected at a second terminal to a second power supply line;

a storage capacitor having a first plate connected to the gate of the drive transistor and a second plate connected to the first terminal of the light-emitting device for compensating a threshold voltage of the drive transistor;

wherein during a combined data programming and threshold compensation phase in which data is programmed and a threshold voltage of the drive transistor is partially compensated, the first terminal of the light-emitting device is electrically connected to a data voltage supply line that supplies a data voltage, the light-emitting device having an internal capacitance that stores the data voltage, and the first terminal of the light-emitting device is electrically disconnected from the data voltage supply line during an extended threshold compensation phase during which the threshold voltage of the drive transistor is further compensated;

a first switch transistor having a first terminal connected to the first terminal of the drive transistor and a second terminal connected to the gate of the drive transistor, wherein when the first switch transistor is in an on state the drive transistor becomes diode-connected such that the gate and the first terminal of the first drive transistor are electrically connected to each other through the first switch transistor;

a second switch transistor having a first terminal connected to the first terminal of the light-emitting device and a second terminal connected to the data voltage supply line that supplies the data voltage, wherein when the second switch transistor is in an on state the data voltage supply line is electrically connected to the first terminal of the light-emitting device through the second switch transistor; and a third switch transistor having a first terminal connected to the second terminal of the drive transistor and a second terminal opposite from the first terminal, wherein when the third switch transistor is in an on state during the emission phase the first terminal of the light-emitting device is electrically connected to the second terminal of the drive transistor through the third switch transistor.

2. The pixel circuit of claim 1, further comprising a fourth switch transistor having a first terminal connected to a reference voltage supply line that supplies a reference voltage and a second terminal connected to the third switch transistor, wherein when the fourth switch transistor is in an on state the third switch transistor is electrically connected to the reference voltage supply line through the fourth switch transistor.

3. The pixel circuit of claim 2, wherein the third switch transistor is a double gate transistor having a first gate and a second get, and the second terminal of the fourth switch transistor is connected at a mid-node connection of the first gate and the second gate of the third switch transistor.

4. The pixel circuit of claim 2, further comprising a fifth switch transistor having a first terminal connected to the second terminal of the third switch transistor and a second terminal connected to the first terminal of the light-emitting device, wherein when the third and fifth switch transistors are in an on state during the emission phase the first terminal of the light-emitting device and the second plate of the storage capacitor are electrically connected to the second terminal of the drive transistor through the third and fifth switch transistors.

5. The pixel circuit of claim 4, further comprising a sixth switch transistor having a first terminal connected to the first voltage supply line and a second terminal connected to the first terminal of the drive transistor, wherein when the sixth switch transistor is in an on state the first terminal of the drive transistor is electrically connected to the first voltage supply line through the sixth switch transistor.

6. The pixel circuit of claim 1, further comprising a second storage capacitor having a first plate connected to the first terminal of the light-emitting device and a second plate connected to a bias voltage supply input, wherein the second storage capacitor increases a total capacitance relative to the first terminal of the light-emitting device to enhance the storage of the data voltage at the light-emitting device.

7. The pixel circuit of claim 1, wherein the light-emitting device is one of an organic light-emitting diode, a micro light-emitting diode (LED), or a quantum dot LED.

8. A method of operating a pixel circuit for a display device comprising the steps of:

providing a pixel circuit comprising:

a drive transistor configured to control an amount of current to a light-emitting device during an emission phase depending upon a voltage applied to a gate of the drive transistor, the drive transistor having a first terminal and a second terminal and the first terminal of the drive transistor is electrically connectable to a first power supply line;

a light-emitting device that is electrically connectable at a first terminal to the second terminal of the drive transistor and is connected at a second terminal to a second power supply line; and a storage capacitor having a first plate connected to the gate of the drive transistor and a second plate connected to the first terminal of the light-emitting device for compensating a threshold voltage of the drive transistor;

performing a combined data programming and threshold compensation phase in which data is programmed and a threshold voltage of the drive transistor is partially compensated, the combined data programming and threshold compensation phase comprising electrically connecting the first terminal of the light-emitting device and the second plate of the storage capacitor to a data voltage supply line that supplies a data voltage, the light-emitting device having an internal capacitance that stores the data voltage;

performing an extended threshold compensation phase during which the threshold voltage of the drive transistor is further compensated comprising electrically disconnecting the first terminal of the light-emitting device from the data voltage supply line, wherein the data voltage remains stored by the internal capacitance of the light-emitting device during the extended threshold compensation phase;

performing an emission phase during which light is emitted from the light-emitting device comprising electrically connecting the first terminal of the drive transistor to the first power supply line to apply the first power supply to the first terminal of the drive transistor, electrically connecting the second plate of the storage capacitor to the second terminal of the drive transistor, and electrically connecting the first terminal of the light-emitting device to the second terminal of the drive transistor thereby applying the first power supply to the light-emitting device; and performing an initialization phase to initialize voltages at the light-emitting device and the drive transistor, the initialization phase comprising:

electrically disconnecting the first terminal of the light-emitting device from the second terminal of the drive transistor;

electrically connecting the first terminal of the light-emitting device and the second plate of the storage capacitor to the data voltage supply line to apply the data voltage, wherein the data voltage is set such that the light-emitting device does not emit light during the initialization phase; and electrically connecting the gate of the drive transistor and the first plate of the storage capacitor to the first voltage supply line to apply the first voltage supply to the gate of the drive transistor and to the first plate of the storage capacitor to reset the gate voltage of the drive transistor.

9. The method of operating a pixel circuit of claim 8, wherein the pixel circuit further comprises a first switch transistor having a first terminal connected to the first terminal of the drive transistor and a second terminal connected to the gate of the drive transistor;

wherein the method of operating the pixel circuit includes placing the first switch transistor in an on state whereby the drive transistor becomes diode-connected such that the gate and the first terminal of the drive transistor are electrically connected to each other through the first switch transistor, and the first voltage supply is applied to the gate of the drive transistor through the diode-connected first switch transistor during the initialization phase, combined data programming and threshold compensation phase, and the extended threshold compensation phase.

10. The method of operating a pixel circuit of claim 9, wherein the pixel circuit further comprises a second switch transistor having a first terminal connected to the first terminal of the light-emitting device and a second terminal connected to the data voltage supply line that supplies the data voltage;

wherein the method of operating the pixel circuit includes placing the second switch transistor in an on state to electrically connect the data voltage supply line to the first terminal of the light-emitting device to apply the data voltage to the first terminal of the light-emitting device and to the second plate of the storage capacitor through the second switch transistor.

11. The method of operating a pixel circuit of claim 8, wherein the pixel circuit further comprises a second storage capacitor having a first plate connected to the first terminal of the light-emitting device and a second plate connected to a bias voltage supply input, wherein the second storage capacitor increases a total capacitance relative to the first terminal of the light-emitting device to enhance the storage of the data voltage at the light-emitting device.

12. A method of operating a pixel circuit for a display device comprising the steps of:

providing a pixel circuit comprising:

a drive transistor configured to control an amount of current to a light-emitting device during an emission phase depending upon a voltage applied to a gate of the drive transistor, the drive transistor having a first terminal and a second terminal and the first terminal of the drive transistor is electrically connectable to a first power supply line;

a light-emitting device that is electrically connectable at a first terminal to the second terminal of the drive transistor and is connected at a second terminal to a second power supply line; and a storage capacitor having a first plate connected to the gate of the drive transistor and a second plate connected to the first terminal of the light-emitting device for compensating a threshold voltage of the drive transistor;

performing a combined data programming and threshold compensation phase in which data is programmed and a threshold voltage of the drive transistor is partially compensated, the combined data programming and threshold compensation phase comprising electrically connecting the first terminal of the light-emitting device and the second plate of the storage capacitor to a data voltage supply line that supplies a data voltage, the light-emitting device having an internal capacitance that stores the data voltage;

performing an extended threshold compensation phase during which the threshold voltage of the drive transistor is further compensated comprising electrically disconnecting the first terminal of the light-emitting device from the data voltage supply line, wherein the data voltage remains stored by the internal capacitance of the light-emitting device during the extended threshold compensation phase; and performing an emission phase during which light is emitted from the light-emitting device comprising electrically connecting the first terminal of the drive transistor to the first power supply line to apply the first power supply to the first terminal of the drive transistor, electrically connecting the second plate of the storage capacitor to the second terminal of the drive transistor, and electrically connecting the first terminal of the light-emitting device to the second terminal of the drive transistor thereby applying the first power supply to the light-emitting device;

wherein the pixel circuit further comprises a second switch transistor having a first terminal connected to the first terminal of the light-emitting device and a second terminal connected to the data voltage supply line that supplies the data voltage;

wherein the method of operating the pixel circuit includes placing the second switch transistor in an on state to electrically connect the data voltage supply line to the first terminal of the light-emitting device to apply the data voltage to the first terminal of the light-emitting device and to the second plate of the storage capacitor through the second switch transistor;

wherein the pixel circuit further comprises a third switch transistor having a first terminal connected to the second terminal of the drive transistor and a second terminal opposite from the first terminal; and wherein the method of operating the pixel circuit includes placing the third switch transistor in an on state during the emission phase to electrically connect the first terminal of the light-emitting device and the second plate of the storage capacitor to the second terminal of the drive transistor through the third switch transistor.

13. The method of operating a pixel circuit of claim 12, wherein the pixel circuit further comprises a fourth switch transistor having a first terminal connected to a reference voltage supply line that supplies a reference voltage and a second terminal connected to the third switch transistor;

wherein the method of operating the pixel circuit includes placing the fourth switch transistor in an on state during the combined data programming and threshold compensation phase and the extended threshold compensation phase to electrically connect the third switch transistor to the reference voltage supply line to apply the reference voltage through the fourth switch transistor, and wherein the method of operating the pixel circuit includes placing the third switch transistor in an on state during the combined data programming and threshold compensation phase and the extended threshold compensation phase to further apply the reference voltage to the second terminal of the drive transistor through the third and fourth switch transistors.

14. The method of operating a pixel circuit of claim 13, wherein the third switch transistor is a double gate transistor having a first gate and a second get, and the second terminal of the fourth switch transistor is connected at a mid-node connection of the first gate and the second gate of the third switch transistor.

15. The method of operating a pixel circuit of claim 13, wherein the pixel circuit further comprises a fifth switch transistor having a first terminal connected to the second terminal of the third switch transistor and a second terminal connected to the first terminal of the light-emitting device;

wherein the emission phase includes placing the third and fifth switch transistors in an on state to electrically connect the first terminal of the light-emitting device and the second plate of the storage capacitor to the second terminal of the drive transistor through the third and fifth switch transistors.

16. The method of operating a pixel circuit of claim 15, wherein the pixel circuit further comprises a sixth switch transistor having a first terminal connected to the first voltage supply line and a second terminal connected to the first terminal of the drive transistor;

wherein the method of operating the pixel circuit includes placing the sixth switch transistor in an on state to electrically connect the first terminal of the drive transistor to the first voltage supply line through the sixth switch transistor.

17. The method of operating a pixel circuit of claim 12, wherein the pixel circuit further comprises a second storage capacitor having a first plate connected to the first terminal of the light-emitting device and a second plate connected to a bias voltage supply input, wherein the second storage capacitor increases a total capacitance relative to the first terminal of the light-emitting device to enhance the storage of the data voltage at the light-emitting device.

* * * * *